US005148792A

United States Patent [19]

Tuckey

[11] Patent Number: 5,148,792

[45] Date of Patent: Sep. 22, 1992

[54] PRESSURE-RESPONSIVE FUEL DELIVERY SYSTEM

[75] Inventor: Charles H. Tuckey, Cass City, Mich.

[73] Assignee: Walbro Corporation, Cass City, Mich.

[21] Appl. No.: 816,730

[22] Filed: Jan. 3, 1992

[51] Int. Cl.[5] ..... F02M 37/04

[52] U.S. Cl. ..... 123/497; 123/514; 137/569

[58] Field of Search ..... 123/497, 506, 514, 494, 123/509; 417/45, 307; 137/563, 569

[56] References Cited

U.S. PATENT DOCUMENTS

| | | | |
|---|---|---|---|
| 3,126,030 | 3/1964 | Stoermer | 137/569 |
| 3,231,003 | 1/1966 | Richcreek, Jr. | 137/563 |
| 3,327,760 | 6/1967 | Crawford, Jr. | 137/563 |
| 3,402,733 | 9/1968 | McAlvay | 137/569 |
| 3,746,027 | 7/1973 | Elliott | 137/569 |
| 4,502,450 | 3/1985 | Duprez | 123/514 |
| 4,577,604 | 3/1986 | Hara et al. | 123/497 |
| 4,606,317 | 8/1986 | Jauch et al. | 123/514 |
| 4,617,116 | 10/1986 | Seiler | 123/514 |
| 4,756,291 | 7/1988 | Cummins et al. | 123/497 |
| 4,807,583 | 2/1989 | Thornthwaite et al. | 123/514 |
| 4,844,704 | 7/1989 | Jiro | 417/47 |
| 4,872,438 | 10/1989 | Ausiello et al. | 123/514 |
| 4,926,829 | 5/1990 | Tuckey | 123/497 |
| 4,951,636 | 8/1990 | Tuckey et al. | 123/497 |
| 4,981,154 | 1/1991 | Bailey et al. | 137/569 |
| 4,984,554 | 1/1991 | Ariga et al. | 123/514 |
| 5,070,849 | 12/1991 | Rich et al. | 123/509 |

FOREIGN PATENT DOCUMENTS

| | | | |
|---|---|---|---|
| 0423636 | 4/1991 | European Pat. Off. | 123/497 |
| 2940442 | 4/1981 | Fed. Rep. of Germany | 137/569 |
| 0140486 | 12/1978 | Japan | 137/569 |
| 1595591 | 8/1981 | United Kingdom | 137/569 |

*Primary Examiner*—E. Rollins Cross
*Assistant Examiner*—Thomas N. Moulis
*Attorney, Agent, or Firm*—Barnes, Kisselle, Raisch, Choate, Whittemore & Hulbert

[57] ABSTRACT

A fuel delivery system for an internal combustion engine that includes a fuel supply with a pump responsive to application of electrical power for supplying fuel under pressure. A fuel injector is coupled to the supply for controlled delivery of fuel from the supply to the engine. A check valve is positioned in the fuel line that connects the pump outlet to the injector to prevent reverse flow of fuel from the injector to the pump when the pump is shut down. A sensor is coupled to the fuel line between the check valve and the pump outlet for providing an electrical signal as a function of fuel pressure at the pump outlet, and electronic control circuitry applies electrical power to the pump as a function of such pressure signal. A fuel bypass is connected to the fuel line between the pump outlet and the check valve for providing an open but restricted fuel flow path from the pump outlet parallel to the fuel line, such that fuel continues to flow through the bypass and the pump continues operation even in the absence of fuel demand at the engine. In this way, the pump maintains a minimum level of operation so as to be able rapidly to accommodate increasing demand for fuel at the engine.

4 Claims, 2 Drawing Sheets

PRESSURE-RESPONSIVE FUEL DELIVERY SYSTEM

The present invention is directed to fuel delivery systems for internal combustion engines and like applications, and more particularly to a system for controlling fuel delivery as a function of fuel requirements.

BACKGROUND AND OBJECTS OF THE INVENTION

It has heretofore been proposed to supply fuel to an internal combustion engine by means of a pressure-controlled electric-motor fuel pump and a one-way or non-return fuel line that connects the pump to the fuel injectors at the engine. For example, U.S. Pat. No. 5,044,344 discloses a fuel delivery system in which a fuel pump is responsive to application of electrical power for supplying fuel under pressure from a supply or tank to the fuel injectors at the engine. A check valve is positioned in the fuel line between the pump outlet and the injectors for preventing reverse flow of fuel from the engine injectors to the pump. A pressure sensor is operatively coupled to the fuel line between the pump outlet and the check valve, and is coupled to electronic circuitry for applying electrical energy to the pump motor as a function of pressure in the fuel line. A pressure relief valve is connected to the fuel line between the check valve and the engine for returning fuel from the line to the supply in the event of over-pressure in the fuel line.

Although the fuel delivery system so disclosed addresses and overcomes a number of problems theretofore extant in the art, further improvements remain desirable. For example, a problem is encountered in pressure-controlled pump systems of the described character in situations where fuel demand at the engine decreases such as during a period of engine deceleration, and thereafter rapidly increases such as when rapid acceleration is demanded by the operator. During the period of low fuel demand at the engine, a low level of pump operation is all that is necessary to maintain desired fuel pressure in the fuel line. However, when demand is rapidly increased, the fuel pump often cannot accelerate operation sufficiently quickly to satisfy the demand.

Another problem extant in the art involves fuel vaporization in the fuel line at very high temperatures. For example, fuel rail temperature tends to increase significantly after the engine is turned off and coolant system operation terminates. The fuel may vaporize in the rail and injector area, particularly when ambient temperature is relatively high. This may cause difficulty in restarting the engine and/or unstable idling performance.

It is therefore a general object of the present invention to provide a fuel delivery system for internal combustion engines in which the fuel pump motor is operated as a function of fuel line pressure while at the same time maintaining a minimum level of pump operation in low fuel demand situations so as to increase the ability of the pump to respond to a subsequent high fuel demand. Another object of the present invention is to provide an engine fuel delivery system of the described character that substantially reduces or prevents vaporization of fuel in the fuel line even under high operating temperature conditions.

SUMMARY OF THE INVENTION

A fuel delivery system for an internal combustion engine in accordance with the present invention includes a fuel supply with a pump responsive to application of electrical power for supplying fuel under pressure. A fuel delivery mechanism, such as a fuel injector, is coupled to the supply for controlled delivery of fuel from the supply to the engine. A check valve is positioned in the fuel line that connects the pump outlet to the injector to prevent reverse flow of fuel from the injector to the pump when the pump is shut down. A sensor is coupled to the fuel line between the check valve and the pump outlet for providing an electrical signal as a function of fuel pressure at the pump outlet, and electronic control circuitry applies electrical power to the pump as a function of such pressure signal. A fuel bypass is connected to the fuel line between the pump outlet and the check valve for providing a continuous open fuel flow path from the pump outlet parallel to the fuel line, such that fuel continues to flow through the bypass and the pump continues operation even in the absence of fuel demand at the engine. In this way, the pump maintains a minimum level of operation so as to be able rapidly to accommodate increasing demand for fuel at the engine. In a presently preferred embodiment of the invention in which the fuel pump takes the form of a self-contained electric-motor fuel pump mounted as a module within a vehicle fuel supply tank, the fuel bypass comprises an orifice formed in the fuel line adjacent to the pump outlet for bypassing fuel directly to the surrounding tank when the fuel line check valve is closed.

A second important aspect of the present invention contemplates a method for preventing vaporization of fuel in the fuel line under hot operating conditions at the engine by locating a pressure relief valve in the fuel line between the check valve and the engine, and adjusting the pressure relief valve to a setting greater than vaporization pressure of the fuel in the line at the predetermined maximum operating temperature of the engine. Preferably, the pressure relief setting of the valve is adjusted at the time of vehicle manufacture to a setting empirically predetermined substantially to prevent vaporization at maximum operating temperature for the particular type of fuel in connection with which the engine will be used. A setting of 64 psi would be typical for gasoline engines, for example.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF THE PREFERRED EMBODIMENT

Figure 1:
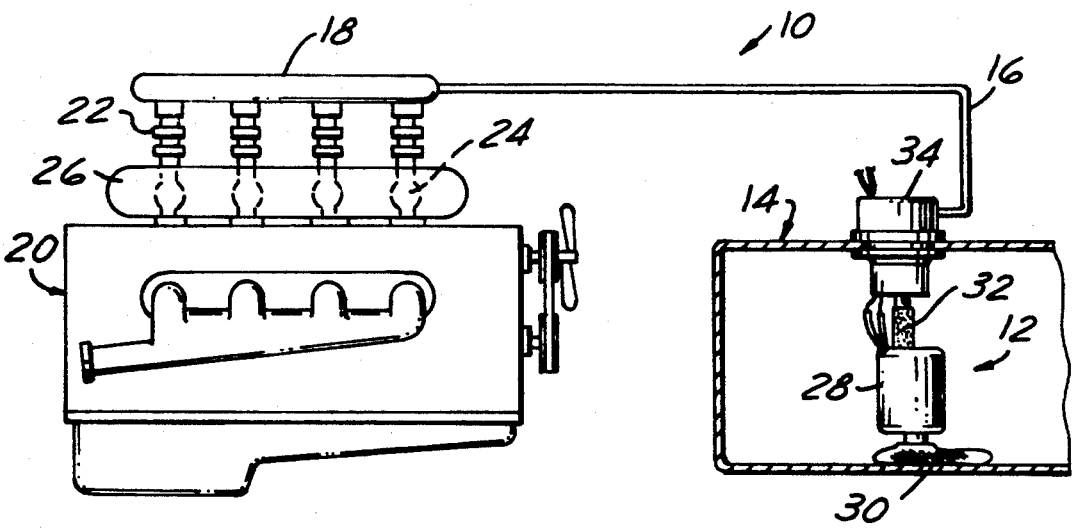
FIG. 1 is a schematic diagram of a fuel delivery system in accordance with a presently preferred embodiment of the invention.

FIG. 1 illustrates a fuel delivery system 10 in accordance with one presently preferred embodiment of the invention as comprising a self-contained fuel pump module 12 mounted within and surrounded by a fuel tank 14. Fuel pump module 12 delivers fuel under pressure through a fuel line 16 to a fuel rail 18 carried by an engine 20. A plurality of fuel injectors 22 are mounted between rail 18 and engine 20, with nozzles of the individual fuel injectors being adjacent to the fuel/air intake ports 24 of associated cylinders of the engine. Combustion air may be supplied to an air intake manifold 26 through an air filter or the like at atmospheric pressure, or by a turbocharger or the like driven by the engine and supplying air at a pressure that varies with engine operation and/or throttle demand, etc. Injectors 22 may be solenoid-activated, for example, responsive to an on-board engine control computer (not shown).

Figure 2:
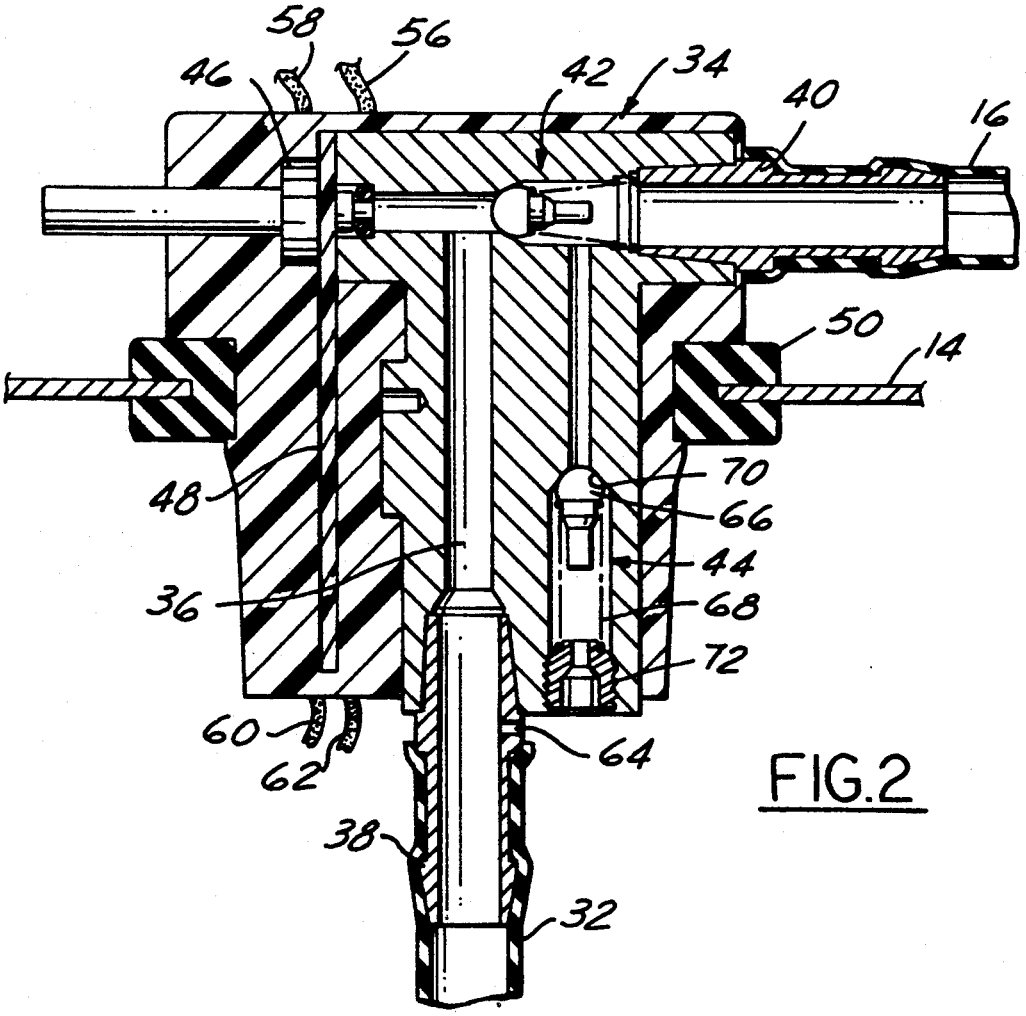
FIG. 2 is a fragmentary sectional view on an enlarged scale of a portion of the fuel delivery system illustrated in FIG. 1.

Fuel pump module 12 includes an electric-motor pump 28 having an inlet that receives fuel from surrounding tank 14 through a filter sock 30, and an outlet that supplies fuel under pressure through a connecting line 32 to a cap/manifold 34. Within manifold 34, as illustrated in FIG. 2, an internal fuel passage 36 is connected at one end to fuel line 32 by a fitting 38, and is connected at the other end to fuel line 16 by a fitting 40. A check valve 42 is positioned in passage 36 for preventing reverse flow of fuel from rail 18 to tank 14 when pump 28 is shut down. A pressure relief valve 44 is mounted within manifold 34 and connected to passage 36 downstream of check valve 42 for returning fuel to tank 14 in the event of an over-pressure condition within fuel line 16 and/or rail 18. A pressure sensor 46 is mounted on a circuitboard assembly 48 carried by manifold 34, and is operatively coupled to fuel passage 36 extending therethrough for suppling an electrical signal as a function of fuel pressure within passage 36 upstream of check valve 42. Manifold 34 is mounted by a gland 50 to close the opening in fuel tank 14 through which fuel pump module 12 is inserted during vehicle assembly.

Figure 3:
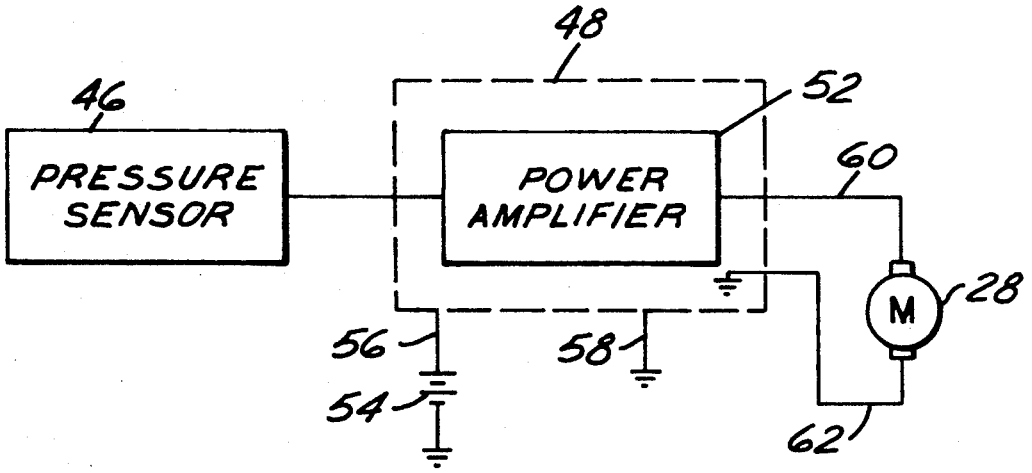
FIG. 3 is a functional block diagram of the fuel delivery system electronics.

As illustrated in FIG. 3, circuitboard 48 includes a power amplifier 52 for supplying a pulse width modulated signal to the motor of pump 28 as a function of the output signal of pressure sensor 46. Circuitboard 48 receives electrical power from a battery 54 and is connected to electrical ground by means of conductors 56, 58 respectively. Likewise, amplifier 52 is connected to pump 28 by means of conductors 60, 62. To the extent thus far described, fuel delivery system 10 is generally similar to that disclosed in U.S. Pat. No. 5,044,344, the disclosure of which is incorporated herein by reference.

In accordance with a first aspect of the present invention, an orifice 64 is drilled or otherwise formed in fitting 38 between line 32 and manifold 34 to provide a continuously open but restricted path for fuel to bypass manifold 34 and return to tank 14. Thus, even when engine fuel demand is at a minimum level and little fuel flows through check valve 42 and fuel line 16, orifice 64 provides a fuel flow path so that pressure sensor 46 will not reduce operation of pump 28 below some minimum level. In this way, if engine fuel demand rapidly increases, such as when the operator desires rapidly to accelerate the vehicle after a period of deceleration, velocity of the fuel pump motor can rapidly increase to the desired level without having to overcome high inertia at low operating speed. During normal operation, the small size of orifice 64 (e.g., 0.030 inches) presents sufficient restriction as not to offset normal fuel flow to the engine.

In accordance with a second aspect of the present invention, pressure relief valve 44 is adjusted to a setting greater than vaporization pressure of fuel in fuel line 16 and fuel rail 18 at the predetermined maximum operating temperature of engine 20. As shown in FIG. 2, check valve 44 includes a valve element 66 urged by a spring 68 against a valve seat 70. A nut 72 provides for adjusting the force of compression of spring 68, and thus the force in the fuel line and fuel rail necessary to overcome spring 68 and return fuel to tank 14. Preferably, such spring force is adjusted to a setting slightly greater than vaporization pressure of specific type of fuel in connection with which the engine is intended to be used at the maximum fuel rail design temperature of the engine. For example, for an engine intended to run on pure gasoline at a maximum design temperature of less than 200° F., the force of spring 68 may be adjusted so that bypass valve 44 will open only when pressure within line 16 and rail 18 exceeds 64 psi. This feature of the invention substantially reduces or eliminates formation of vapor in the fuel line and rail by allowing the fuel pressure to rise to a level that is high enough to keep vapor from forming at the maximum design or worst-case engine temperature. On the other hand, if fuel system pressure becomes excessive due to heat expansion, valve 44 opens to bleed off excess pressure. Thus, by maintaining a high fuel pressure, formation of vapor in the fuel rail and fuel line is reduced or eliminated. Upon restarting of the engine, operation of the injectors rapidly returns rail 18 and line 16 to normal system operating pressures.

I claim:

1. A fuel delivery system for an internal combustion engine that includes:

a fuel supply with a fuel pump responsive to application of electrical power for supplying fuel under pressure, fuel delivery means on the engine, a fuel line having one end connected to an outlet of said pump and a second end connected to said fuel delivery means, a check valve in said fuel line for preventing reverse flow of fuel from said delivery means to said pump, means for applying electrical power to said pump, including a sensor coupled to said line between said check valve and said pump for providing an electrical signal as a function of fuel pressure at said pump outlet and means for applying electrical power to said pump as a function of said signal, and fuel bypass means coupled to said fuel line between said pump outlet and said check valve for providing a restricted fuel flow path from said pump outlet parallel to said line, such that fuel continues to flow through said bypass means and said pump continues operation in the absence of fuel demand at said fuel delivery means.

2. The system set forth in claim 1 wherein said fuel bypass means comprises a continuously open fuel flow passage from said pump outlet to said supply.

3. The system set forth in claim 2 wherein said fuel bypass means comprises an orifice in said fuel line adjacent to said outlet within said supply.

4. In a fuel delivery system for an internal combustion engine having a predetermined maximum design operating temperature, in which the system includes a fuel supply including a pump, fuel delivery means on the engine, a fuel line that connects said pump to said delivery means, a check valve in said line to prevent reverse flow of fuel from the engine to the pump and a pressure relief valve connected to said fuel line between the check valve and the engine, a method of preventing vaporization of fuel in said line under hot operating conditions at said engine comprising the step of adjusting said pressure relief valve to a setting greater than vaporization pressure of fuel in said line at said predetermined maximum design operating temperature.

* * * * *